US007201339B2

(12) United States Patent
Ford

(10) Patent No.: US 7,201,339 B2
(45) Date of Patent: Apr. 10, 2007

(54) METHOD AND APPARATUS FOR PRODUCING WOOD SHAVINGS

(75) Inventor: Darrell Ford, Kamloops (CA)

(73) Assignee: Westwood Fibre Ltd., Kamloops (CA)

( * ) Notice: Subject to any disclaimer, the term of this patent is extended or adjusted under 35 U.S.C. 154(b) by 451 days.

(21) Appl. No.: 10/894,029

(22) Filed: Jul. 20, 2004

(65) Prior Publication Data

US 2006/0016514 A1 Jan. 26, 2006

(51) Int. Cl.

| | |
|---|---|
| ***B02C 15/00*** | (2006.01) |
| ***B02C 19/00*** | (2006.01) |
| ***B27C 1/00*** | (2006.01) |
| ***B27C 5/00*** | (2006.01) |
| ***B27G 13/00*** | (2006.01) |

(52) U.S. Cl. ..... 241/92; 241/152.2; 144/42; 144/176; 144/180; 144/246.1; 144/218

(58) Field of Classification Search ..... 241/92, 241/152.2, 47, 223, 239; 144/1.1, 3.1, 42, 144/162.1, 176, 185, 186, 180, 242.1, 246.1, 144/248.1, 363, 373, 218

See application file for complete search history.

(56) References Cited

U.S. PATENT DOCUMENTS

| | | | | |
|---|---|---|---|---|
| 624,514 | A * | 5/1899 | MacKinnon | 144/186 |
| 2,004,753 | A * | 6/1935 | Gredell | 241/74 |
| 2,130,457 | A * | 9/1938 | Fickett et al. | 144/176 |
| 3,069,101 | A * | 12/1962 | Wexell | 241/92 |
| 3,286,745 | A | 11/1966 | Meis | |
| 3,346,027 | A * | 10/1967 | Kirsten | 144/176 |
| 4,055,309 | A * | 10/1977 | Fleming et al. | 241/221 |
| 4,059,233 | A * | 11/1977 | Dion | 241/47 |
| 4,155,384 | A * | 5/1979 | Svensson | 144/176 |
| 4,492,343 | A | 1/1985 | Jaakonmaki et al. | |
| 4,493,352 | A | 1/1985 | Jaakonmaki et al. | |
| 5,020,579 | A | 6/1991 | Strong | |
| 5,060,873 | A | 10/1991 | Strong | |
| 5,143,311 | A | 9/1992 | Laster | |
| 5,261,469 | A | 11/1993 | Severson | |
| 5,323,975 | A * | 6/1994 | Fulghum, Jr. | 241/92 |
| 5,427,162 | A | 6/1995 | Carter | |
| 5,477,900 | A * | 12/1995 | Gray | 144/180 |
| 5,829,500 | A * | 11/1998 | Van Elten | 144/185 |
| 6,152,200 | A | 11/2000 | Smothers | |
| 6,524,442 | B2 | 2/2003 | Tanner et al. | |

FOREIGN PATENT DOCUMENTS

| | | |
|---|---|---|
| CA | 557559 | 5/1958 |
| CA | 630297 | 11/1961 |
| CA | 991833 | 6/1976 |
| CA | 1111742 | 11/1981 |
| CA | 2132876 | 9/1993 |

* cited by examiner

*Primary Examiner*—Bena Miller
(74) *Attorney, Agent, or Firm*—Antony C. Edwards

(57) ABSTRACT

A heavy flywheel disc having a radially spaced apart array of pockets in which are mounted knives. Short logs, which have been de-barked, are fed in with their long axis parallel to the face of the flywheel. A hydraulic ram translates the logs sideways into the plane containing the rotating knives. The use of the hydraulic ram provides for a variable infeed speed to obtain the particular thickness of shavings which provides in the end commercially desirable shavings for use, for example, in horse stables. The knives have notched cutting edges. The notches limit the width of each shaving to create strands which are for example ¾ inches wide. The strands are then chopped in an automated chopping device such as a forage harvester to produce shavings.

11 Claims, 8 Drawing Sheets

METHOD AND APPARATUS FOR PRODUCING WOOD SHAVINGS

FIELD OF THE INVENTION

This invention relates to the field of wood shaving and chipping machines.

BACKGROUND OF THE INVENTION

Devices for producing wood shavings from pieces of wood have long been known in art. By way of example, Canadian Patent No. 557,559 which issued to Steiner et al. on May 20, 1958, for an invention entitled Production of Shavings from Pieces of Wood discloses that it was then known to produce shavings for the manufacture of wood particle panels and other similar composite products. Pieces of wood waste are disintegrated on rotary-disk type shredding machines into shavings having pre-determined and properly chosen properties and dimensions, particularly shavings of a flat and pliably thin shape. Such rotary-disk machines include a rotating disk equipped with a number of blades whose edges extend along respective radii of the disk. Pieces of a wood of a given length are placed into a feed box which is traversed against the rotating blades. The shavings may be sub-divided by the use of scoring knives rotating together with and ahead of the cutter blades mounted on the rotating-disk. The blade-carrying disk extends in a vertical plane and has a horizontal shaft. The feed box is pressed and moved along with the woodpieces on a horizontal path towards the blades.

Other prior art such as Canadian Patent Application No. 2,132,876 filed by Rice and published Sep. 30, 1993, entitled Apparatus and Method for Making Wood Curls discloses a mechanized disk flaker for producing curled food flakes. The disk flaker includes a rotatable disk plate having one or more cutting knives mounted to the disk plate so as to provide a slight rake angle between the tool face and a plane perpendicular to the direction of tool travel. The disk flaker includes rotatable and removable knife holders and also includes the use of scoring knives.

In the prior art, applicant is also aware of Canadian Patent No. 991,833 which issued to Schaefer on Jun. 29, 1976, for A Knife for a Wood Shaving Machine. Schaefer discloses that the use of scoring knives may be replaced by the use scoring protrusions formed on the cutting edges of the knives used to produce wood shavings. In particular, Schaefer discloses the use of a bent-out cutting portion which results in a scoring edge, or a U or V-shaped bead which produces a scoring beak located outside the cutting edge, or the use of a punched-out flow extending from the cutting edge transversely where the blade is bent out to provide a scoring edge.

In the prior art, applicant is also aware of Canadian Patent No. 630,297 which issued Fahrni on Nov. 7, 1961, for A Process and Apparatus for Producing Shaving. Consistent with other prior art, Fahrni discloses the use of a shaving blade and a scoring blade, both mounted on a rotating disk where both the shaving blade and the scoring blade project from the disk face. Scoring blade includes a plurality of spaced groove-cutting projections which extend from the disk face by a distance slightly greater than the distance of the cutting edge of the shaving blade from the disk face. Fahrni also discloses that the shaving blade and the scoring blade may be included in a single unitary cutting means, or may be separate elements mounted in contact with each other or spaced from each other.

SUMMARY OF THE INVENTION

The device according to the present invention uses a heavy flywheel disc having a radially spaced apart array of pockets in which are mounted knives. In one embodiment, six pockets are used with the flywheel rotating at approximately 550 rpm. Short logs, which have been de-barked, are fed in with their long axis parallel to the face of the flywheel. A hydraulic ram forces the logs sideways into the plane containing the rotating knives. The use of the hydraulic ram provides for a variable infeed speed to obtain the particular thickness of shavings which provides in the end commercially shavings desirable for use, for example, in horse stables. If the ram pressure is too great, the scoring by means of the present invention of the wood slices so as to form strands, as better described below, may be defeated resulting in non-segmented sheets of shavings. The optimal depth of shaving cut may be approximately 0.004 of an inch, although it is intended that thicker cuts, for example 0.015 inches, may be made. The knives have notched cutting edges. The notches limit the width of each shaving to create strands which are for example ¾ inches wide. The strands are then chopped in an automated chopping device such as a forage harvester to produce shavings, for example approximately ¾ inch×¾ inch×0.004 inch in shape.

In one aspect, the invention includes the use on the cutting edge on each knife of notches or slits formed into the cutting edge of the knife, where the notches or slits do not protrude from the edge of the knife, but which still operate to score the shaving to limit the length and width of the shaving. This creates ribbon-like shaving strands of controlled length and width which may then be chopped to form shavings.

In summary, the present invention may be characterized as a device for producing shavings from woodpieces which includes an infeed for translating woodpieces in a direction of flow from an upstream loading position to a downstream shaving position. The woodpieces are oriented on the infeed transversely relative to the direction of flow. A flywheel is rotatably mounted transversely across the downstream position in the infeed. The axis of rotation of the flywheel may be substantially parallel to the direction of flow. The axis of rotation may bisect the infeed at the downstream position. The apertures and corresponding knives extend substantially from the axis of rotation radially outwardly. The flywheel has a radially spaced apart array of apertures formed therein, radially spaced around an axis of rotation of the flywheel.

A radially spaced apart array of elongate slicing knives are mounted to the flywheel. Each knife has a cutting edge which is elevated and inclined at a cutting angle relative to an upstream face of the flywheel so as to slice into the woodpieces when a woodpiece is pressed against the upstream face by means for selectively pressing the woodpieces. The flywheel is rotated so as to bring sequentially each cutting edge into slicing engagement with the woodpiece. Each cutting edge has a spaced apart array of slits formed therein, spaced apart by a distance corresponding to a desired shaving-strand width dimension. The slits are formed so as to extend perpendicularly into the each knife from the cutting edge without any scoring protrusion protruding from the cutting edge. The strands are delivered to a means cooperating with the flywheel for cutting the strands into shavings.

The means cooperating with the flywheel for cutting the strands into shavings may include a device such as a forage harvester having at least one knife for chopping the strands into shavings. The device may include a gravity-feed hopper for collecting the strands downstream of the flywheel and for feeding the strands to the chopping knife. A conveyor may be provided for conveying the strands from the flywheel into the hopper. A pair of counter-rotating rolls may be mounted at the downstream end of the conveyor for pressing the strands between the pair of rolls before the strands fall into the hopper. One roll of the pair of rolls may have a resilient outer surface.

The strands as they are sliced from the woodpiece by the slicing engagement of the knives pass through a corresponding pocket and exit from a downstream face of the flywheel opposite the upstream face of the flywheel.

The infeed at the downstream position may include a rigid housing for temporarily storing a queue of parallel woodpieces. The housing has an upstream infeed aperture for receiving the woodpieces in the direction of flow, and a downstream outfeed aperture adjacent the upstream face of the flywheel. The outfeed aperture is generally laterally centered on the axis of rotation. The means for selectively translating the woodpieces into the slicing engagement may include a selectively actuable actuator for urging a downstream-most woodpiece in the queue of woodpieces through the outfeed aperture into slicing engagement with the knives on the flywheel. The actuator is selectively actuable to controllably vary the forward speed of the actuator so as to control the feed speed of the downstream-most woodpiece.

BRIEF DESCRIPTION OF THE DRAWINGS

With reference to the drawings wherein similar characters of reference denote corresponding parts in each view.

DETAILED DESCRIPTION OF EMBODIMENTS OF THE INVENTION

Figure 1:
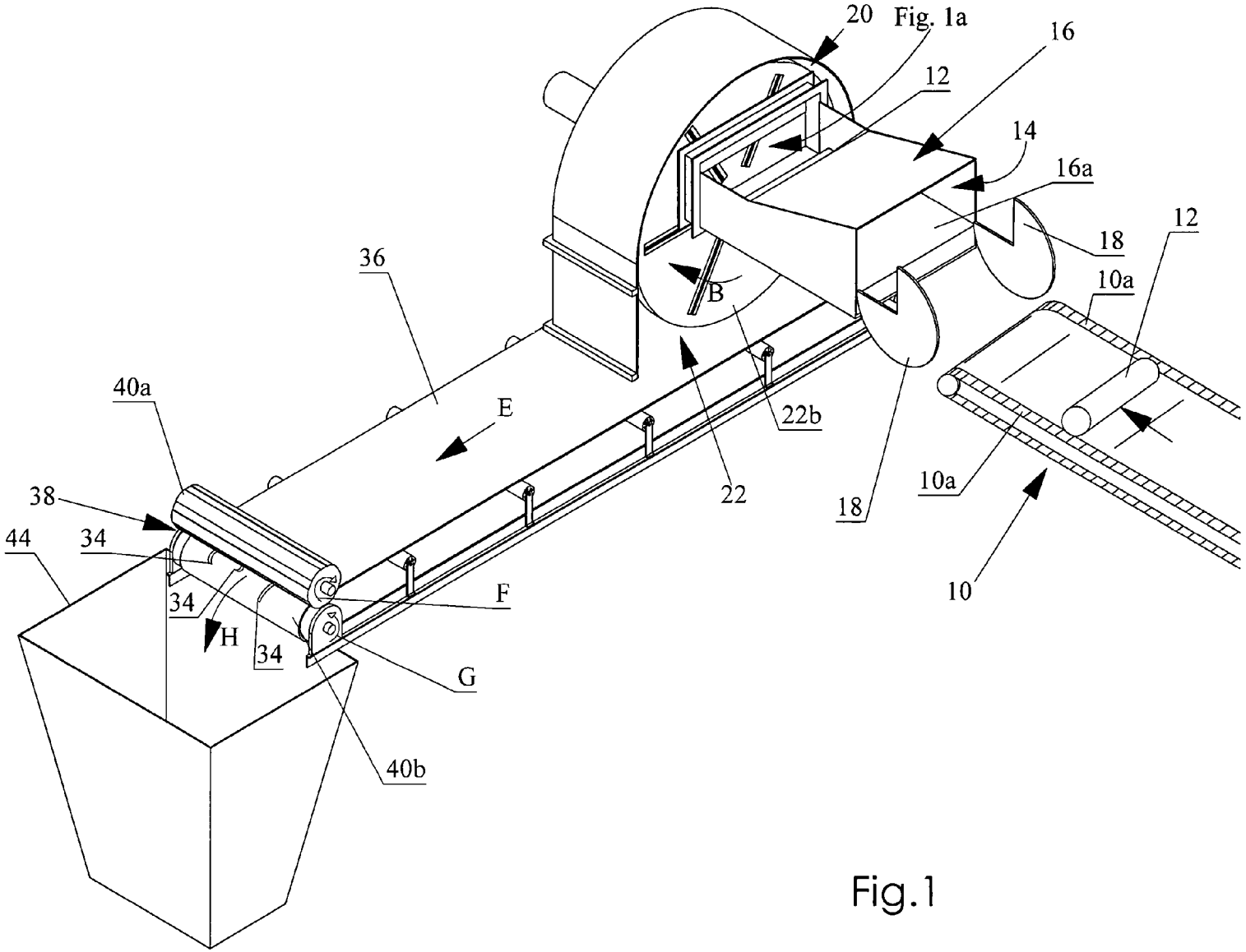
FIG. 1 is, in perspective view, the apparatus for producing wood shavings according to the present invention.
Figure 1A:
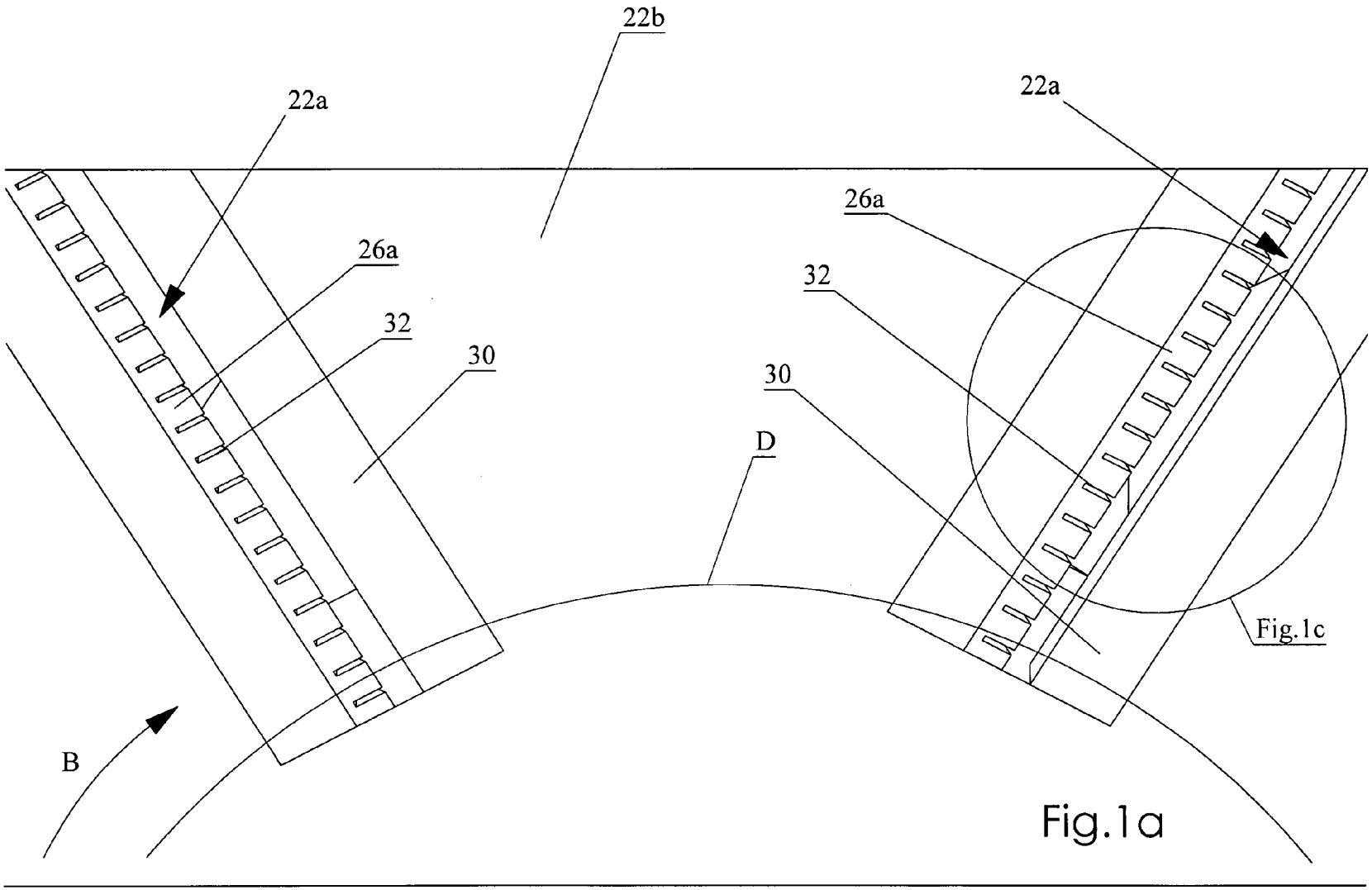
FIG. 1*a* is an enlarged partially cut away view at the infeed face to the shaving disk as illustrated in FIG. 1 wherein the view is in front elevation view relative to the disk.
Figure 1B:
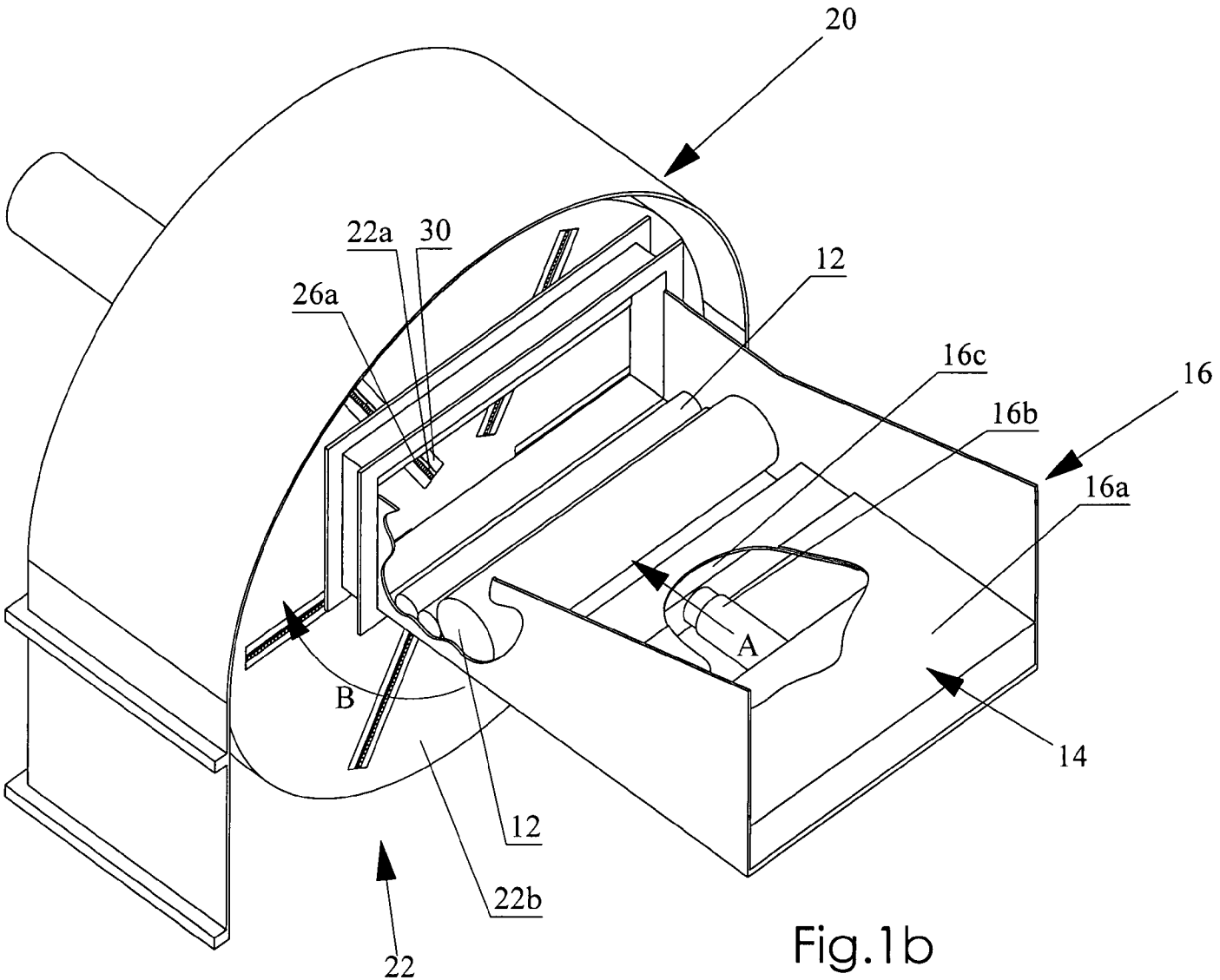
FIG. 1*b* is, in partially cut away enlarged view, the infeed and shaving disk of FIG. 1.
Figure 1C:
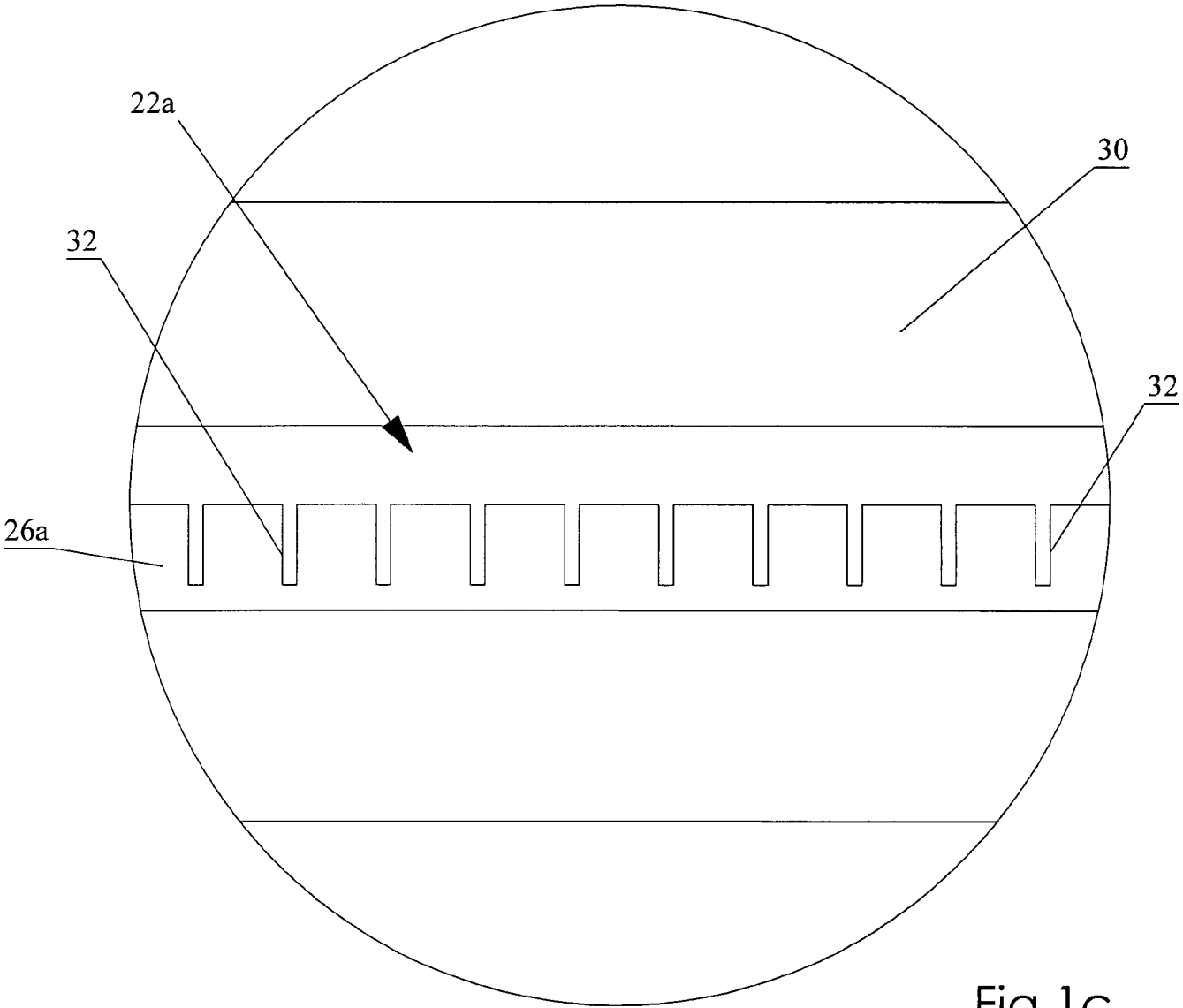
FIG. 1*c* is an enlarged view of a portion of FIG. 1*a*.
Figure 2:
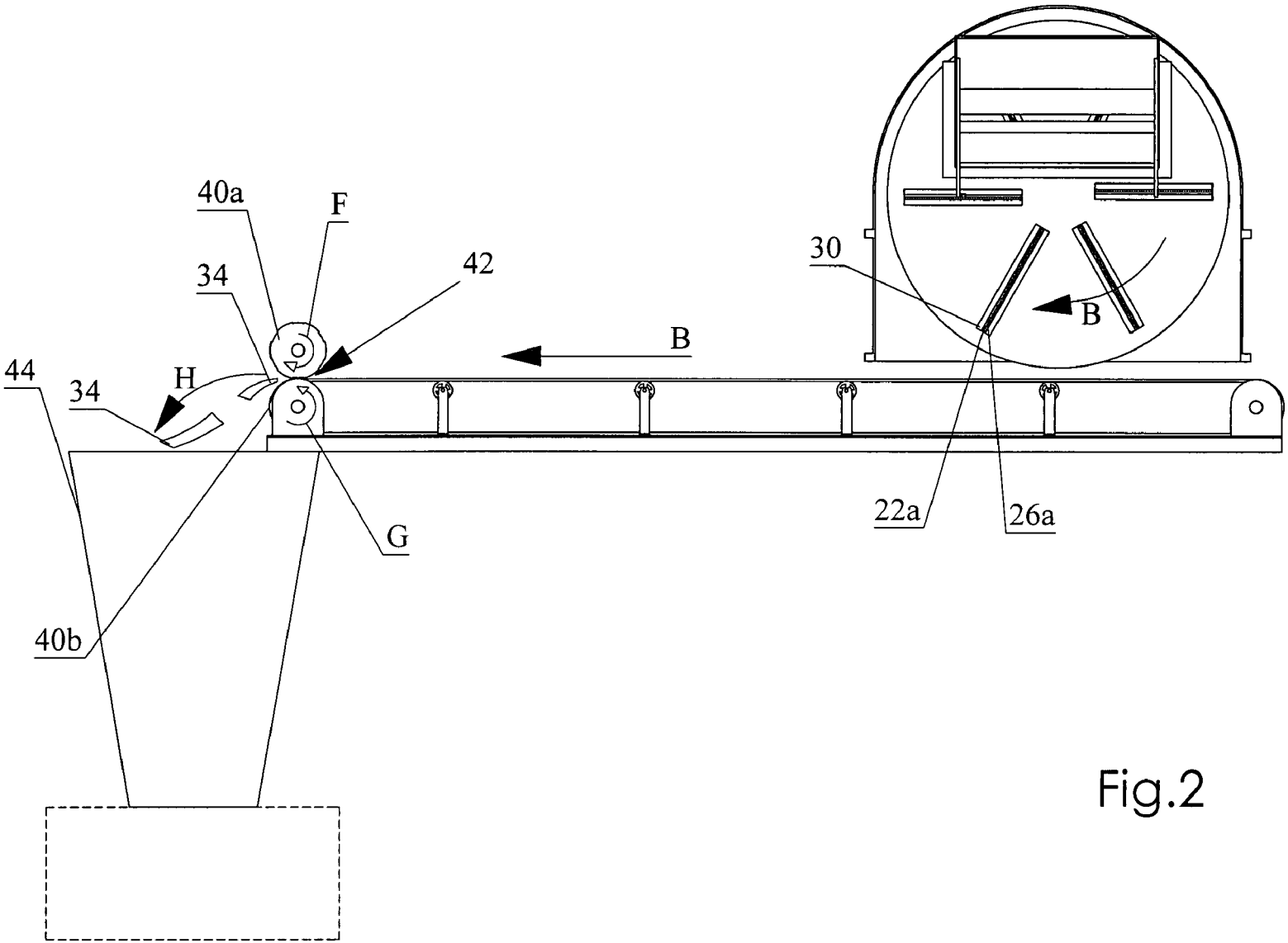
FIG. 2 is, in partially cut away front elevation view, the apparatus of FIG. 1.
Figure 3:
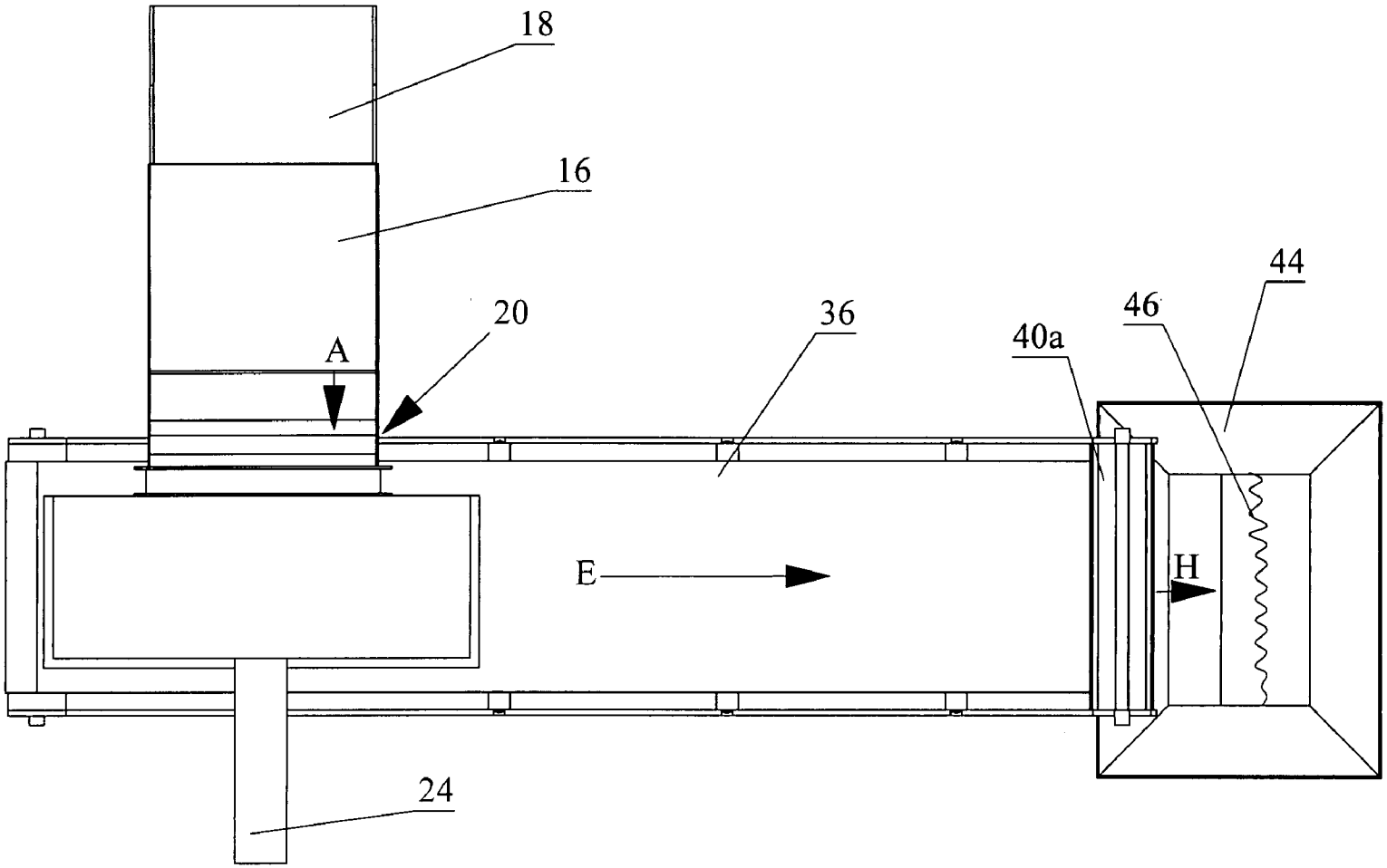
FIG. 3 is, in plan view, the apparatus of FIG. 2.
Figure 4:
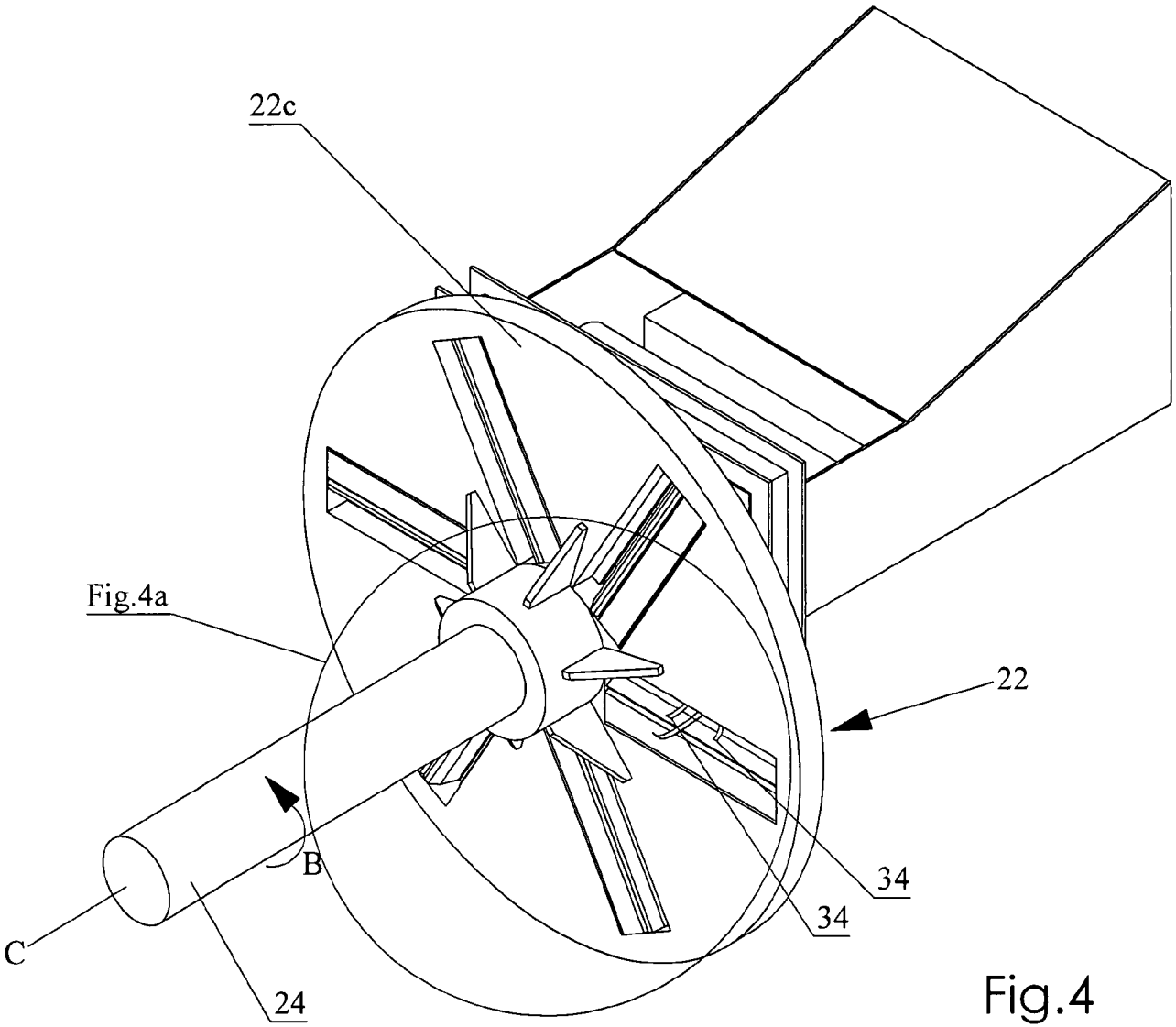
FIG. 4 is, in rear elevation view, the apparatus of FIG. 1*b* with the shaving disk housing removed.
Figure 4A:
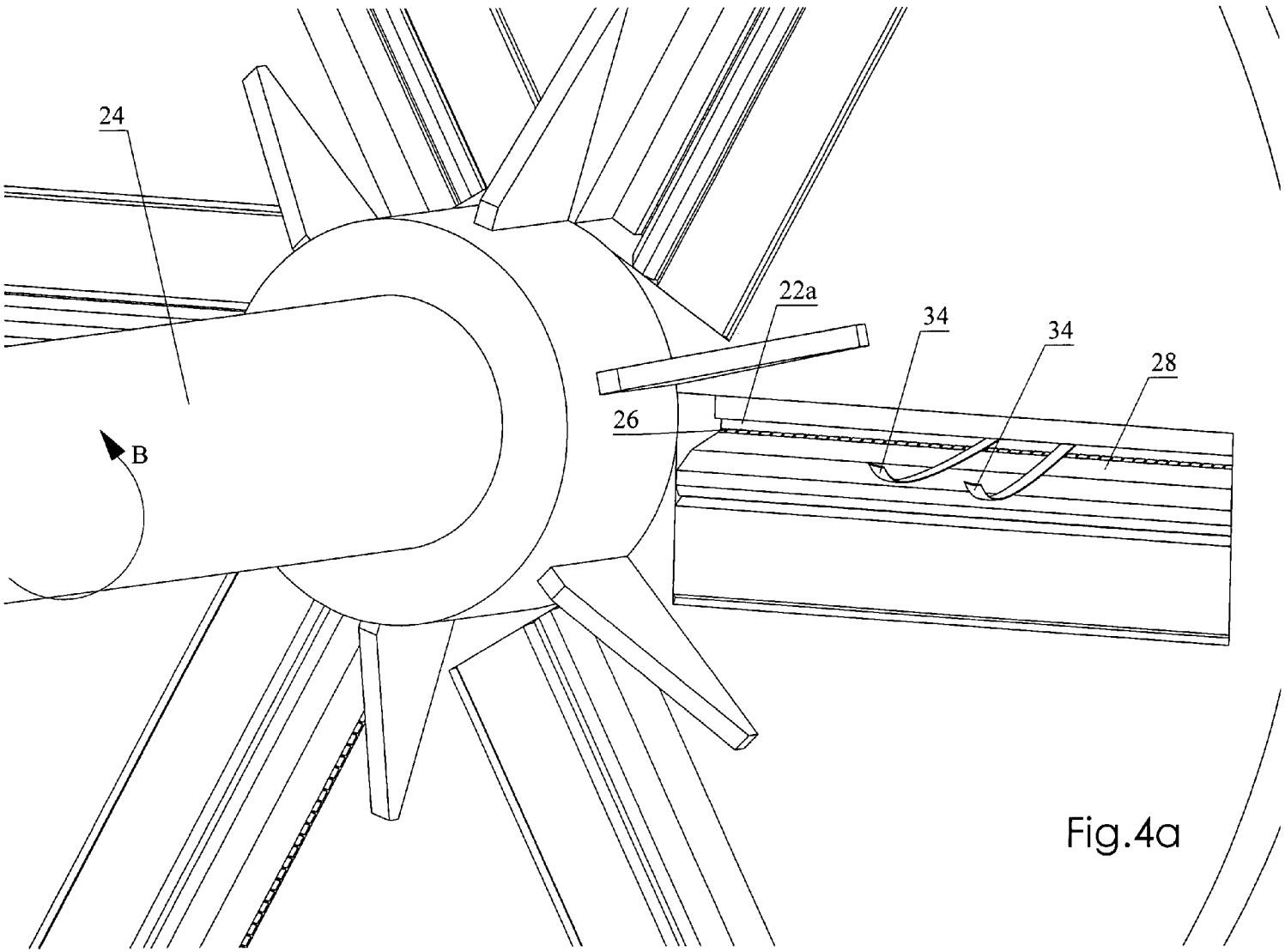
FIG. 4*a* is, in partially cut away enlarged view, a portion of FIG. 4.

A chain conveyor 10 feeds log segments 12, typically logs cut to approximately three or four foot lengths (collectively herein referred to as logs), transversely on chainways 10*a* to an infeed aperture 14 feeding actuated log feeder 16. A log singulator 18 singulates and places logs into aperture 14. Logs from the singulator slide or roll across sheeted deck 16*a* so as to stack in a queue above and upstream of feeder actuator 16*b*. Actuator 16*b* drives log bearing member 16*c* in direction A, thereby driving logs transversely at a selectively controlled rate also in direction A so as to be engaged by log shaver 20.

Log shaver 20 includes a planar flywheel 22 rotatably mounted on drive shaft 24 in a vertical plane orthogonal to direction A. A motor and drive coupling (not shown) rotates drive shaft 24 so as to rotate flywheel 22 in direction B. Flywheel 22 includes a radially spaced apart array of radially extending pockets or slots 22*a*. Slots 22*a* extend radially outwardly of axis of rotation C of flywheel 22. An elongate knife 26 is mounted in each slot 22*a* by a knife holder 28 bolted to the flywheel. Each knife 26 is angularly offset by approximately thirty degrees from the plane of the upstream face 32*b* of the flywheel and positioned so that a cutting edge 26*a* protrudes slightly beyond the plane of the upstream face 22*b* oppositely disposed to knives 26 across slots 22*a*. Wear plates 30 are inset almost entirely into upstream face 22*b*. The depth of cut of knives 26 is regulated by the mounting of knives 26 relative to the upstream surface of the wear plates. Optimally cutting edges 26*a* protrude approximately 0.004–0.015 inches beyond the wear surface of wear plates 30. In practice, the shaving thickness may vary depending on application and market of final products.

Cutting edges 26*a* have notches or slits 32 in spaced apart array along their length. Slits may advantageously be 1/16 inches in width by 3/16 inches deep, and may be spaced apart approximately ¾ inches between each slit. A log 12 engaging cutting edges 26*a* while the flywheel is turning at approximately 550 rpm are shaved into strands 34 by the slicing into the log of successive cutting edges 26*a* and slits 32 moving in an arc relative to the transversely oriented log pressed against shaving face 22*b* and wear plates 30. The translation of cutting edges 26*a* and slits 32 in their arc, illustrated by way of example as arc D, slice the knives across the grain of the log shaving an elongate strand 34 having its length oriented generally at an angle across the wood grain direction. Strands 34 are truncated by engaging slits 32 in slicing engagement so as to slice across the log as the slits move in their semi-circular path relative to the log face so as to keep the strand from getting unmanageably long. For example, strands 34 may be in the order of four to 24 inches long. Strands 34 exit from the slots at the rear face 22*c* of the flywheel and drop onto, for transport in direction E, a conveyor 36. Conveyor 36 delivers strands 34 to a strand chopper 38 which reduces the length of strands 34 to a chip length of for example ¾ inch resulting in shavings which may be approximately ¾×¾ inches by 0.004 inches thick, depending on the pre-set depth-of-cut of the knives. The key to the shavings thickness is the very accurate control of the forward speed of the ram that presents the log to the disk. That is: Disk rpm of 550×6 pockets×0.004 inches per cut=13.2 inches of wood presented to the disc to be shaved to 0.004 inches per minute. The key to controlling the shavings to 0.004 inches is to control the forward speed of the ram to the 13.2 inches, not the pressure. If less than 13 inches is presented the shavings will be thinner, if more than 13 inches is presented, the shavings will be thicker. There are a number of ways to control the speed. In one embodiment, a controlled high pressure hydraulic system is used to control forward speed. Other systems that may be used include mechanical, pneumatic, variable frequency drives, gears etc.

Strand chopper 38 includes a pair of transversely aligned closed adjacent parallel feed rolls 40*a* and 40*b* counter-rotating respectively in directions F and G. The surface of roll 40*a* has a softly resilient raised tread. The counter-rotating pair of rolls 40*a* and 40*b* form a nip 42 therebetween for accepting strands 34 from conveyor 36 into pinched engagement between the rolls. Strands 34 are pressed between the rolls, commencing through nip 42 and exiting downstream in direction H for gravity feed into a hopper 44 gravity feeding a strand chopper 46, such as a John Deere™ 3970 forage harvester. The forage harvester is statically-mounted and turned on end for the gravity infeed from hopper 44, to chop strands 34 into shorter shavings 34*a* by means of knives in the harvester cutting the strands against corresponding anvils or stationary blades.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A device for producing shavings from woodpieces comprising:

an infeed for translating woodpieces in a direction of flow from an upstream loading position to a downstream shaving position, wherein the woodpieces are oriented on the infeed transversely relative to the direction of flow, a flywheel rotatably mounted transversely across said downstream shaving position, said flywheel having a radially spaced apart array of apertures formed therein, radially spaced around an axis of rotation of said flywheel, a radially spaced apart array of elongate slicing knives mounted to said flywheel, each knife of said array of elongate slicing knives having a cutting edge elevated and inclined at a cutting angle relative to an upstream face of said flywheel so as to slice into the woodpieces when a woodpiece is pressed against said upstream face and said flywheel rotated so as to bring sequentially each said cutting edge into slicing engagement with the woodpiece, means for selectively translating the woodpieces downstream into said slicing engagement, wherein each said cutting edge has a spaced apart array of slits formed therein, spaced apart by a distance corresponding to a desired width dimension of a shaving-strand formed by said slicing engagement, wherein said slits are formed so as to extend perpendicularly into said each knife from said each cutting edge without any scoring protrusion protruding therefrom, a means cooperating with said flywheel for cutting the strands formed by said slicing engagement into shavings.

2. The device of claim 1 wherein said means cooperating with said flywheel for cutting into shavings the strands formed by said slicing engagement includes a device having at least one knife for chopping the strands.

3. The device of claim 2 wherein said device having at least one knife includes a gravity-feed hopper for collecting the strands downstream of said flywheel and for feeding the strands to the at least one knife.

4. The device of claim 3 further comprising a conveyor for conveying the strands from said flywheel into said hopper, and a pair of counter-rotating rolls mounted at the downstream end of said conveyor for pressing the strands between said pair of rolls before the strands fall into said hopper.

5. The device of claim 4 wherein one roll of said pair of rolls has a resilient outer surface.

6. The device of claim 2 wherein said means cooperating with said flywheel includes a forage harvester.

7. The device of claim 1 wherein said apertures are elongate pockets and wherein said cutting angle is substantially 30 degrees, so that the strands as they are sliced from the woodpiece by said slicing engagement pass through a corresponding pocket of said pockets and exit from a downstream face of said flywheel opposite said upstream face of said flywheel.

8. The device of claim 1 wherein said axis of rotation of said flywheel is substantially parallel to said direction of flow.

9. The device of claim 8 wherein said axis of rotation bisects said infeed at said downstream position, and wherein said apertures and corresponding said knives extend substantially from said axis of rotation radially outwardly.

10. The device of claim 9 wherein said infeed at said downstream position includes a rigid housing for storing a queue of parallel woodpieces, said housing having an upstream infeed aperture for receiving the woodpieces in the direction of flow, and a downstream outfeed aperture adjacent said upstream face of said flywheel and generally laterally centered on said axis of rotation, and wherein said means for selectively pressing the woodpieces into said slicing engagement includes a selectively actuable actuator for urging a downstream-most woodpiece in the queue of woodpieces through said outfeed aperture into said slicing engagement with said knives on said flywheel.

11. The device of claim 10 wherein said actuator is selectively actuable to controllably vary a compressive force and forward speed exerted by said actuator against the downstream-most woodpiece.

* * * * *